US005923117A

United States Patent [19]

Azzi et al.

[11] Patent Number: 5,923,117

[45] Date of Patent: Jul. 13, 1999

[54] DEFLECTION YOKE SECURING DEVICE

[75] Inventors: Nacerdine Azzi, Genlis; Jean-Philippe Descombes, Premieres, both of France

[73] Assignee: Thomson Tubes And Displays, S.A., France

[21] Appl. No.: 08/844,814

[22] Filed: Apr. 22, 1997

[51] Int. Cl.[6] ..... H01J 29/70

[52] U.S. Cl. ..... 313/440; 313/433; 335/210; 335/213

[58] Field of Search ..... 313/404, 440, 313/292, 437, 413, 433; 335/213, 210, 211

[56] References Cited

U.S. PATENT DOCUMENTS 5,350,968 9/1994 Kwon ..... 313/440
5,780,968 7/1998 Matsuoka et al. ..... 313/440

FOREIGN PATENT DOCUMENTS 0690470 1/1996 European Pat. Off. .
0690471 1/1996 European Pat. Off. .

OTHER PUBLICATIONS

Patent Abstracts of Japan vol. 008, No. 044, & JP 58 198833A, Nov. 18, 1983.

Patent Abstracts of Japan vol. 011, No. 077, & JP 61 233938A, Oct. 18, 1986.

*Primary Examiner*—Vip Patel
*Attorney, Agent, or Firm*—Joseph S. Tripoli; Joseph J. Laks; Francis A. Davenport

[57] ABSTRACT

An electron beam deflection device for cathode ray tubes comprises a pair of vertical deflection coils, a pair of horizontal deflection coils. At least one of the vertical deflection coils and the horizontal deflection coils has a saddle shape. A rigid separator supports the deflection coil pairs and insulating one from the other. An attachment element is coupled to the separator for securing the separator to a neck portion of the tube. The attachment element has a position on the neck and extends into a region under the vertical deflection coil pair.

12 Claims, 4 Drawing Sheets

DEFLECTION YOKE SECURING DEVICE

FIELD OF THE INVENTION

This invention relates to an electron beam deflection system for cathode ray tubes, and in particularly to a device for ensuring the immobilization of said system on the tube neck.

BACKGROUND INFORMATION

Such a deflection system, also called a deflector or deflection yoke assembly generally comprises of a pair of vertical deflection coils, a pair of horizontal deflection coils, and a ring essentially in the shape of a truncated cone of magnetic material intended to concentrate the flux created by the coils. The horizontal deflection coils are generally in the shape of a saddle; the vertical deflection coils may also be saddle shaped, or may be formed as a torus wound around a ring of magnetic material.

The two pairs of deflection coils are insulated electrically by a separator, generally of plastic material. In addition the separator provides mechanical rigidity to the deflection device, allows positioning of the coils relative to each other and facilitates adjustment the assembled unit on the tube neck. The separator comprises a main body, and one or more parts, essentially in the shape of a funnel, with a flexible back part which adjoins the neck of the tube to allow the deflection system to secured on the longitudinal or Z axis of the tube. This tube neck attachment is generally accomplished by a collar or clamp arranged about the flexible back part of the separator.

During the assembly of the components comprising the deflector, the deflection coils are installed on the separator and positioned one with the other to enable the generation of vertical and horizontal deflection fields, in accordance with the cathode ray tube with which the deflector is intended to operate. The deflector is then located on the tube neck and positioned along the axis Z of the tube such that in the absence of deflecting fields, the three electron beams generated by the electron gun converge at the CRT screen. The deflector is maintained in this position generally by means of the locking collar or clamp positioned on the back annular part of the separator. The annular part of the separator is designed to have the necessary flexibility to facilitate the sliding introduction of the deflector onto the tube neck and the subsequent locking thereon.

However, this yoke assembly clamping method requires that the outer annular surface of the separator, at the back end of the deflection coils, extends beyond the coils to provide the necessary flexible area for clamping following Z axis adjustment. Thus the length of the yoke assembly may influence the other neck components and the length of the tube neck which supports them. The tube neck and yoke assembly lengths are of particular importance with deflectors having saddle shaped vertical deflection coils which extend further along the Z axis than toroidally wound coils. In addition, since the trend in current television receiver design is directed to a reduction in overall size and, since the overall dimensions are largely determined by the cathode ray tube, receiver depth may be reduced by the use of CRTs with shorter neck lengths thus requiring yoke assemblies with a similar length reduction.

SUMMARY OF THE INVENTION

Deflector length may be reduced in accordance with an inventive arrangement wherein an electron beam deflection device for cathode ray tubes comprises a pair of vertical deflection coils and a pair of horizontal deflection coils, wherein at least one of the vertical deflection coils and the horizontal deflection coils has a saddle shape. A rigid separator supports the deflection coil pairs and insulating one from the other. An attachment element is coupled to the separator for securing the separator to a neck portion of the tube. The attachment element has a position on the neck and extends into a region under the vertical deflection coil pair.

DESCRIPTION OF THE DISCLOSURE

Figure 1:
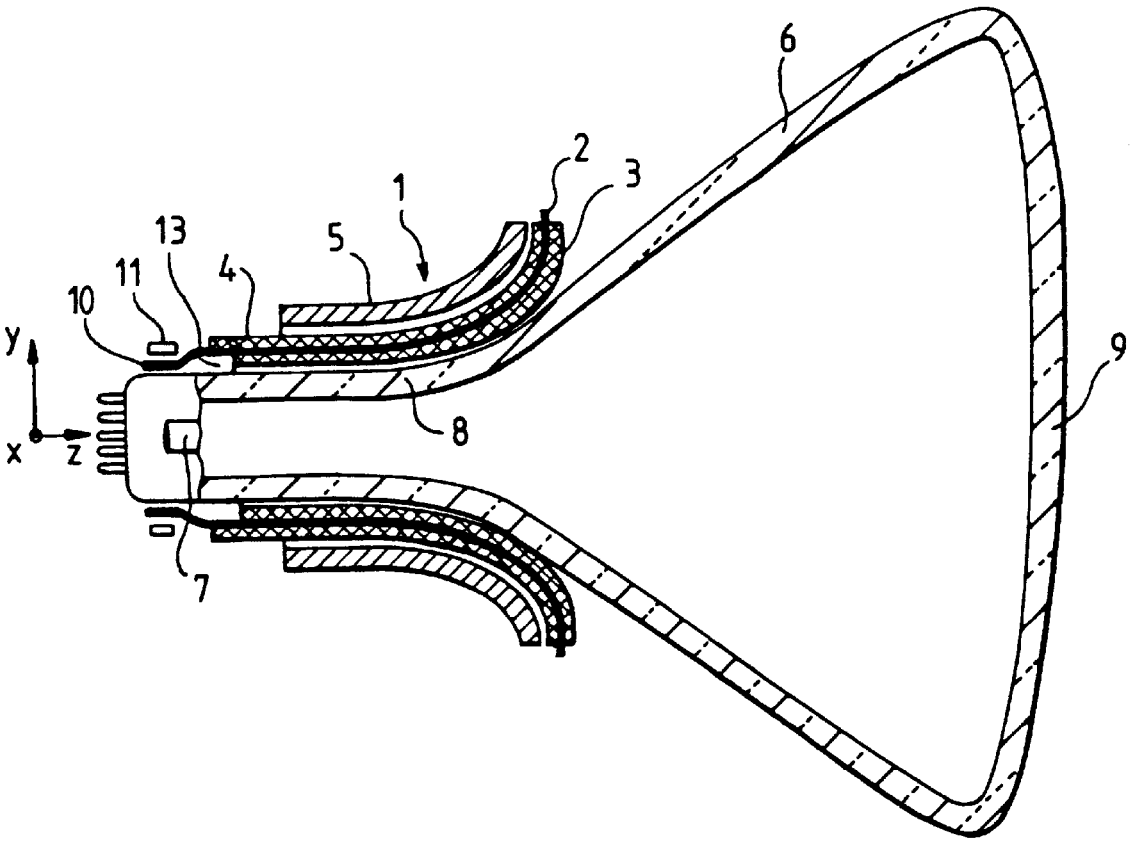
FIG. 1 shows a transverse cutaway view of a deflection device positioned on a cathode ray tube.

A cathode ray tube 6 with deflection yoke assembly is illustrated in section by FIG. 1. The deflection yoke assembly also called a deflector, includes a saddle shaped pair of horizontal deflection coils 3, a pair of vertical deflection coils 4 also saddle shaped and insulated from the horizontal coil pair by a separator 2. A ring of ferromagnetic material 5 is arranged around the coils 3 and 4. The deflection yoke assembly is mounted on the neck 8 of a cathode ray tube 6, to deflect electron beams from electron gun 7, along X and Y axes to form a raster on screen surface 9. During the assembly of the deflector elements the deflection coils are arranged on the body of the separator and their relative positioning adjusted to generate deflection fields of the desired conformation. Following this adjustment the coils should remain in place until the subsequent stage of immobilization on the separator, generally achieved by gluing the coils to the separator body. The deflector is then installed on tube neck 8 in a precise Z axis position to regulate the position of the horizontal and vertical centers of deflection. Following this adjustment the deflector is secured to the tube neck by a locking collar 11 positioned on the back part 10 of the separator. Locking collar 11 exerts an essentially radial force which presses part 10 against the tube neck.

In the case where the horizontal 3 and vertical 4 deflection coils are saddle shaped, their respective lengths along the Z axis are essentially the same. The separator 2 shifts coils 4 relative to the coils 3 such that the back part of the vertical deflection coils extends more toward the cylindrical or gun end of the tube than the horizontal deflection coils. When the vertical deflection coils are toroidal, and wound around the ring of magnetic material 5, the length of the vertical deflection windings is hardly greater than the length along the Z axis of the ring 5. It may happen that for needs connected to the performance sought, the length of ring 5 is such that the back part of the vertical deflection coils extends toward the cylindrical end of the tube and beyond the horizontal deflection coils.

In order to shorten the length of the deflector, an inventive securing embodiment utilizes conductor free space 13, in part situated under the back end of the vertical deflection coils 4 and at the back of the horizontal deflection coils 3. In accordance with the invention, the zone of action of attachment element 21, which secures the deflector to the tube neck, may be located to extend into conductor free space 13.

Figure 3:
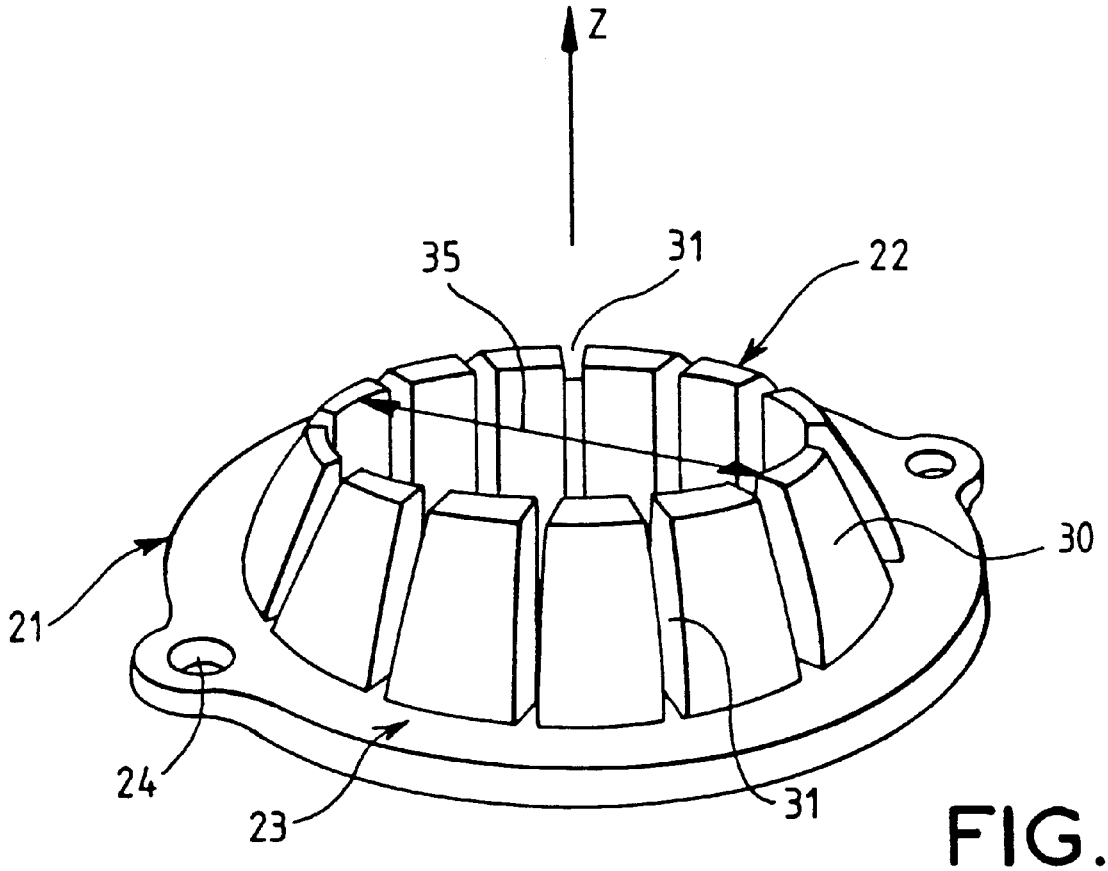
FIG. 3 shows an inventive attachment device for securing the deflector to the tube neck.

FIG. 3 illustrates inventive attachment element 21 which may be considered to comprise least two parts: a first part comprising an annular ring 23, which provides mechanical attachment of element 21 to the yoke separator, and a second part 22, designed to provide circumferential attachment of the separator to the tube neck. Part 22 may be considered to be formed as a hollow truncated cone pierced or serrated with radial openings 31, that create a series of teeth 30. The inside surface of the ring shaped cone is cylindrical, having a diameter 35, slightly greater than the diameter of the tube neck. The joining element is, for example, an annular collar 23 pierced with openings 24 in a direction parallel to the axis of revolution of the ring 22.

Figure 2:
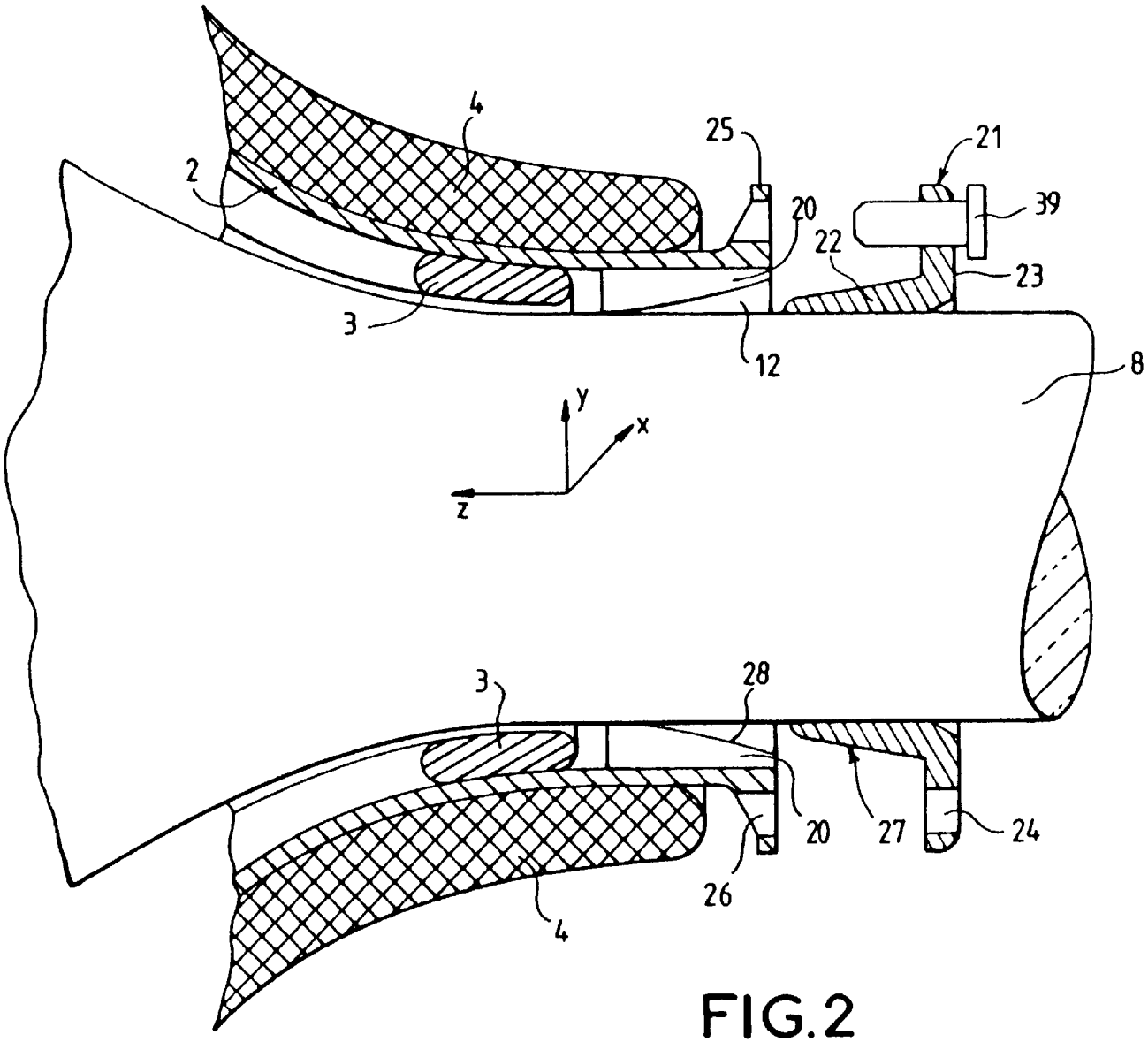
FIG. 2 shows a cutaway drawing of a deflection device including an inventive arrangement.

FIG. 2 is an example of implementation of the invention using an advantageous securing or locking element depicted by FIG. 3. Separator 2 is formed with a cylindrical end terminating in a flange or collar 25. The collar 25 contains at least two openings 26, diametrically opposed and located to face openings 24 in collar 23 of the attachment element. The internal surface of the cylindrical end of separator 2 is formed as an annular ring 20 with a truncated cone shaped internal orifice that defines a conical shaped surface 28.

Following Z axis adjustment, the yoke assembly/separator is secured to the tube neck by the sliding insertion of element 21 onto the neck towards the deflector assembly. The serrated truncated cone 22 of the element 21 penetrates free space 12 located between the separator and the tube neck, under the back of vertical deflection coils 4. Cone shaped element 22 slides under and engages with the conical surface 28 of annular ring or shoulder 20. Since conical surfaces 27 and 28 of respective parts 21 and 20 are complementary, the surfaces contact one with the other. The sliding insertion of locking element 21 into annular ring/shoulder 20 deforms flexible teeth 30 radially to press against and grip the surface 8 of the tube neck. Thus the back of the deflector assembly is secured by frictional contact between teeth 30 and tube neck 8.

Figure 6:
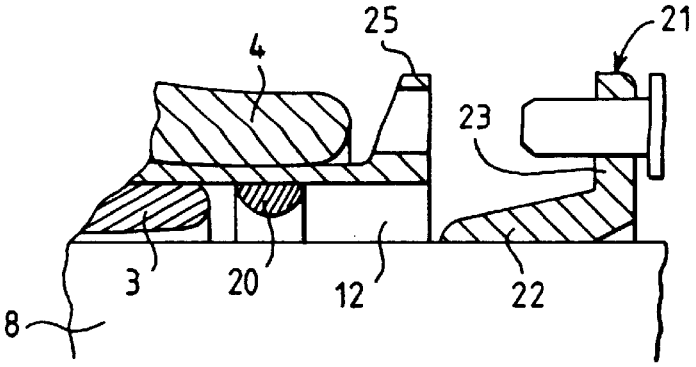
FIG. 6 illustrates in a cutaway view, another advantageous embodiment for securing the deflector to the tube neck.

FIG. 6 shows a partial sectional view through the tube and separator end which illustrates an alternative inventive embodiment where the shape of the contact area of annular ring/shoulder 20 which is not complementary to the shape of the part 22. In FIG. 6, annular ring/shoulder 20 is formed with a semicircular cross section. The sliding insertion of locking element 21, as described with respect to FIG. 2, will result in shoulder/ring 20 contacting and deflecting flexible part 22, essentially a serrated cone, against the glass surface of the tube. Thus the deflector assembly is secured by the locking effect of the frictional contact.

During sliding insertion, part 21 may be rotated on the tube neck to align openings 24 of collar 23 with openings 26 formed in flange surface 25. The immobilization of the deflector on the neck is made permanent by securing element 21 to the separator by means of screws 39 which mate with threaded openings 26.

Figure 5:
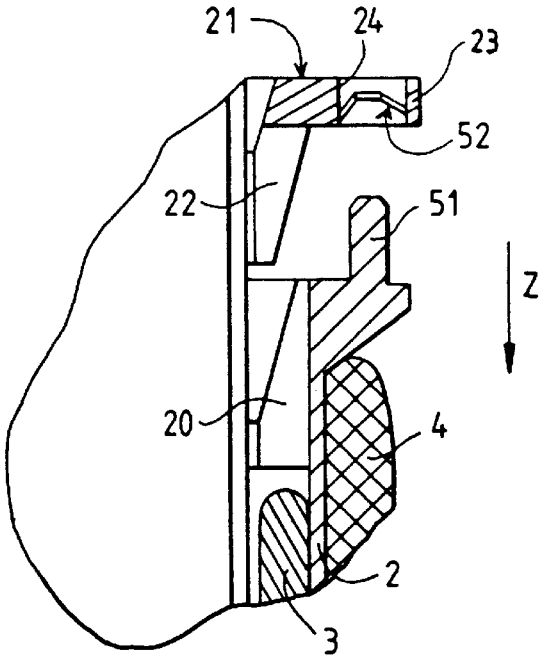

In a further inventive embodiment, depicted in FIG. 5, pins or dowels 51 are formed as part of the separator body 2 and extend toward the back of the latter in a direction parallel to the Z axis. These dowel pins are designed to be mated or inserted into lock washers 52 arranged in openings 24 of annular ring or collar 23 of element 21. The shape of lock washer 52 is such that dowel 51 may not be withdrawn or removed following insertion, thus permanently securing of attachment element 21 to the separator 2.

The inventive use of dowel 51 and lock washer 52 to secure element 21 advantageous facilitates a single operation which combines the sliding insertion of element 21 into the deflector assembly and secure attachment the deflector assembly to the tube neck.

Figure 4:
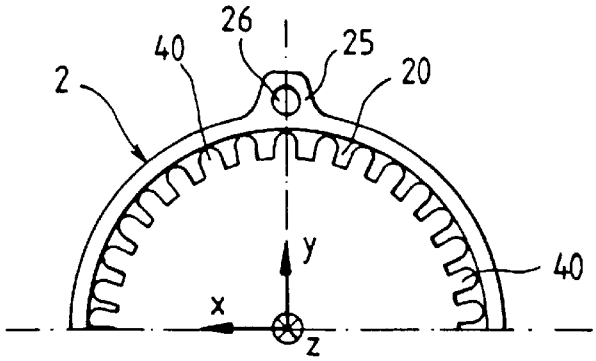
FIG. 4 represents a sectional view along the Z axis of the back part of the separator including an inventive arrangement, FIG. 5 show an further arrangement for securing the inventive attachment device.

The annular ring or shoulder 20 of separator 2 may be formed as a monobloc or integral part by, for example, injection molding plastic material to produce the separator. Alternatively annular ring 20 may be a separate part and, for example glued or ultrasonically welded to the separator. In this latter case the material may be differ from that of the separator and may be chosen as a function of its own qualities. In FIG. 4, serrations or channels 40 may be formed in surface 28 in order to reduce the mass of the annular shoulder 20.

Attachment element 21 may be formed as a monobloc structure by injection molding of a plastic material. In an alternative mode of implementation the element 21 may be formed from at least two pieces of different material. In this latter case the material comprising the collar 23 may be chosen for these qualities of high mechanical rigidity, for example plastic or metal, while the material of part 22 may be, for example, rubber or silicon, selected for flexibility and/or to improve frictional contact with the glass neck to prevent any slippage after immobilization.

What is claimed is:

1. An electron beam deflection device for cathode ray tubes comprising:

a pair of vertical deflection coils;

a pair of horizontal deflection coils, wherein at least one of said vertical deflection coils and said horizontal deflection coils having a saddle shape;

a rigid separator for supporting said deflection coil pairs and insulating one from the other;

an attachment element coupled to said separator for securing said separator to a neck portion of said tube, wherein said attachment element having a position on said neck and extending into a region under said vertical deflection coil pair.

2. The device of claim 1, wherein said attachment element comprises a hollow truncated cone which contacts a surface of said separator.

3. The device of claim 1, wherein said attachment element is deformable in a direction substantially radial to a Z axis of said neck.

4. The device of claim 1, wherein said attachment element comprises at least two different materials.

5. The device of claim 2, wherein said hollow truncated cone is serrated substantially radially to a Z axis of said neck.

6. The device of claim 1, wherein said surface of said separator includes serrations substantially radial to a Z axis of said neck.

7. The device of claim 1, wherein said surface of said separator has a substantially hollow cone shape.

8. The device of claim 3, wherein said attachment element is deformable to grip said neck circumferentially.

9. The device of claim 1, wherein said attachment element is attached to said separator by a dowel engaged with a lock washer.

10. An electron beam deflection assembly for a cathode ray tube comprising:

a horizontal coil pair and a vertical coil pair being arranged on a separator, wherein one of said coil pairs is formed in the shape of a saddle;

said separator, said horizontal and said vertical coil pairs being slidably aligned to a position on a neck portion of a cathode ray tube;

a securing means having a hollow serrated conical shape being slidably mounted on said neck portion of said cathode ray tube such that said serrated conical shape contacts said separator for flexible deformation against said neck portion to frictionally secure said separator in said aligned position.

11. The electron beam deflection assembly of claim 10, wherein said securing means is attached to said separator by a dowel engaged with a lock washer.

12. The electron beam deflection assembly of claim 10, wherein said serrated conical shape is deformable to grip said neck circumferentially.

* * * * *